US006363541B1

(12) United States Patent
Tylka

(10) Patent No.: US 6,363,541 B1
(45) Date of Patent: Apr. 2, 2002

(54) PORTABLE AND DISPOSABLE HYGIENE DEVICE

(76) Inventor: Patricia A. Tylka, 79 Sunnyhill Dr., Mt. Lebanon, PA (US) 15228

( * ) Notice: Subject to any disclaimer, the term of this patent is extended or adjusted under 35 U.S.C. 154(b) by 0 days.

(21) Appl. No.: 09/527,926

(22) Filed: Mar. 17, 2000

Related U.S. Application Data

(60) Provisional application No. 60/131,276, filed on Apr. 27, 1999.

(51) Int. Cl.[7] ..... A47K 11/00

(52) U.S. Cl. ..... 4/144.1; 383/33; 383/109

(58) Field of Search ..... 4/144.1, 144.3, 4/259, 258, 285; 383/33, 36, 109, 113

(56) References Cited

U.S. PATENT DOCUMENTS

| | | | | | |
|---|---|---|---|---|---|
| 478,873 | A | * | 7/1892 | Koehler | 4/259 |
| 807,293 | A | * | 12/1905 | Lee | 4/259 |
| 907,875 | A | * | 12/1908 | Pritchard | 4/259 |
| 988,453 | A | * | 4/1911 | Forney | 4/259 |
| 1,245,610 | A | * | 11/1917 | O'Brien | 4/259 |
| 1,980,953 | A | * | 11/1934 | Kilmer | 4/259 |
| 2,654,892 | A | | 10/1953 | Szabo | 4/110 |
| 3,095,578 | A | | 7/1963 | Stanford | 4/110 |
| 3,475,767 | A | | 11/1969 | Friesen et al. | 4/110 |
| 4,500,314 | A | * | 2/1985 | Brendling | 4/144.1 |
| 5,044,774 | A | * | 9/1991 | Bullard et al. | 383/33 |
| 5,147,343 | A | | 9/1992 | Kellenberger | 604/368 |
| 5,354,132 | A | | 10/1994 | Young et al. | 383/49 |
| 5,404,999 | A | * | 4/1995 | Bednar | 206/204 |
| 5,641,117 | A | * | 6/1997 | Barker et al. | 4/259 |
| 5,647,670 | A | * | 7/1997 | Iscovich | 383/33 |
| 5,745,926 | A | * | 5/1998 | Cailleteau | 4/144.1 |
| 5,852,830 | A | * | 12/1998 | Horn | 383/33 |
| 5,883,028 | A | | 3/1999 | Morman et al. | 442/394 |
| 5,885,263 | A | | 3/1999 | Gancet et al. | 604/359 |
| 5,885,908 | A | | 3/1999 | Jaeger et al. | 442/59 |
| 5,886,124 | A | | 3/1999 | Kightlinger et al. | 527/312 |
| 6,070,277 | A | * | 6/2000 | Thomas | 4/144.1 |

FOREIGN PATENT DOCUMENTS

| | | | | |
|---|---|---|---|---|
| GB | 704418 | * | 2/1954 | 4/259 |

* cited by examiner

*Primary Examiner*—Charles R. Eloshway
(74) *Attorney, Agent, or Firm*—Webb Ziesenheim Logsdon Orkin & Hanson, P.C.

(57) ABSTRACT

A container for collecting, absorbing and retaining human or animal waste material that can be used with one hand is disclosed. The container is formed as a portable and disposable bag defining an internal pocket having a mouth opening. A resiliently deformable collar member surrounds a periphery of the mouth opening and defines the mouth opening. A nonpermeable and flexible outer layer defines the internal pocket and encloses the collar member. A liquid absorbent inner layer is positioned in the internal pocket and is attached to the outer layer. The inner layer forms a surface of the internal pocket and is adapted to absorb liquid waste material. The container is further adapted to retain solid waste material deposited in the internal pocket.

10 Claims, 2 Drawing Sheets

PORTABLE AND DISPOSABLE HYGIENE DEVICE

CROSS REFERENCE TO RELATED APPLICATION

This application claims the benefit of U.S. Provisional Patent Application Ser. No. 60/131,276, filed Apr. 27, 1999, entitled "Portable and Disposable Hygiene Device".

BACKGROUND OF THE INVENTION

1. Field of the Invention

The present invention relates to a portable and disposable hygiene device and, more particularly, to a portable and disposable container for collecting, absorbing and retaining human or animal waste material that can be used with one hand.

2. Description of the Prior Art

Portable fluid containment bags are known in the prior art. For example, U.S. Pat. No. 5,354,132 to Young et al. (hereinafter "the Young patent") discloses a containment and disposable bag for collecting human bodily fluids. The bag defines a hollow interior and has a partially open top for receiving the bodily fluids. A funnel structure is positioned within the bag to channel the bodily fluids into the interior of the bag and to restrict expulsion of the bodily fluids from the interior. The bag is generally made of a lightweight, flexible nonpermeable plastic material. An elongated stiffener element is disposed around the periphery of the open top of the bag and is adapted to bias the open top outwardly. A quantity of absorbent material is located within the bag. In particular, the absorbent material is located near a bottom of the bag. The complicated nature of the internal funnel structure makes the fluid containment bag disclosed by the Young patent expensive to fabricate. Furthermore, the fluid containment bag disclosed by the Young patent requires the use of an absorbent gelling material positioned in the interior of the bag.

Other fluid disposable devices are known from U.S. Pat. Nos. 3,475,767 to Freestone et al. (hereinafter "the Freestone patent"); U.S. Pat. No. 3,095,578 to Stanford; and U.S. Pat. No. 2,654,892 to Szabo. The Freestone patent discloses a sanitary disposable receiver for liquid and solid waste materials and is formed as an elongated bag. The receiver disclosed by the Freestone patent has an outer layer, a water resistant coating on an inner surface of the outer layer and a layer of absorbent material in the bottom interior of the receiver. The receiver disclosed by the Freestone patent does not provide a convenient structure for maintaining the opening of the receiver in an open position while a user utilizes the receiver. Consequently, the receiver disclosed by the Freestone patent is difficult in practice to use because it requires the user to use at least one hand to maintain the receiver opening in the open position. The Szabo patent discloses a relief container for use in automobiles that is similar to the device disclosed by the Freestone patent, but uses a solid ring member to maintain the container in an open position. However, this ring member makes the container disclosed by the Szabo patent difficult, in practice, to close.

Clearly, there is a need for a convenient, practical and inexpensive fluid and solid waste containment bag that can be used by persons who are away from home or without access to conventional bathroom facilities. Each of the above-discussed prior art references has disadvantages that are overcome by the present invention.

Therefore, the object of the present invention is to provide an improved portable and disposable hygiene device for collecting, absorbing and retaining liquid and solid waste material that can be used with one hand.

SUMMARY OF THE INVENTION

The present invention relates to a portable and disposable container for collecting, absorbing and retaining human or animal waste material.

A container is formed as an elongated bag having a mouth opening. A resiliently deformable collar surrounds a periphery of the mouth opening and defines the mouth opening. A nonpermeable flexible outer layer encloses the collar member and defines an internal pocket of the container. A liquid absorbent inner layer is positioned in the internal pocket and is attached to the outer layer. The inner layer forms the surface of the internal pocket and is adapted to absorb liquid waste material. The container is adapted to retain solid waste material deposited in the internal pocket.

The container may be tubular-shaped with one closed end. The inner layer is preferably thermally bonded to the outer layer, and may be thermally bonded to the outer layer along substantially an entire outer surface of the inner layer. The inner layer may also be adhesively bonded to the outer layer.

The collar member may be made of rubber, or may be made of cardboard material having a sufficient thickness such that the cardboard collar member is at least partially resiliently deformable. The outer layer may be a textured non-woven breathable elastic film. The inner layer is generally adapted to absorb between about 50 and 500 cubic centimeters of liquid human waste material. Furthermore, the inner layer may be made of any one of the following materials: cotton, wood pulp fluff, and porous fiber matrix. The inner layer may include superabsorbent polymers and hydrogels therein for absorbing liquid waste materials. Generally, the container is adapted to be used with one hand by a user.

Further details and advantages of the present invention will become apparent in the following detailed description in conjunction with the drawings.

DETAILED DESCRIPTION OF THE PREFERRED EMBODIMENTS

Figure 1:
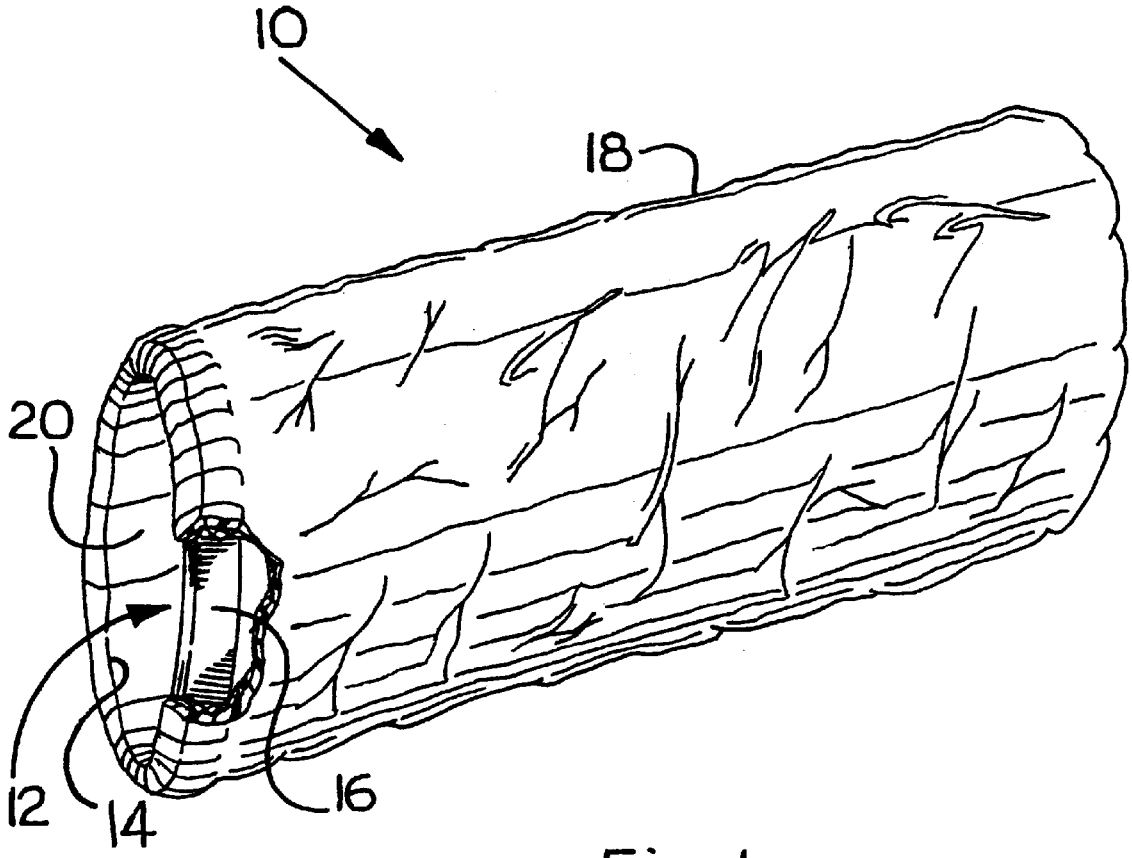
FIG. 1 is a perspective and partially cut-away view of a portable and disposable hygiene device made in accordance with the present invention.
Figure 2:
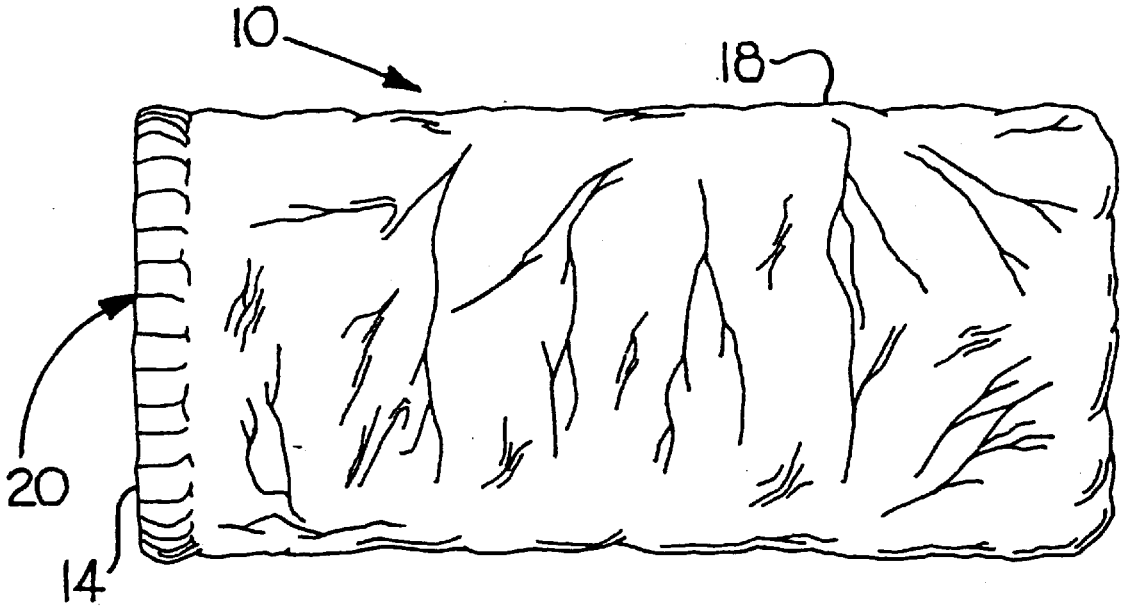
FIG. 2 is a side view of the portable and disposable hygiene device shown in FIG. 1.
Figure 3:
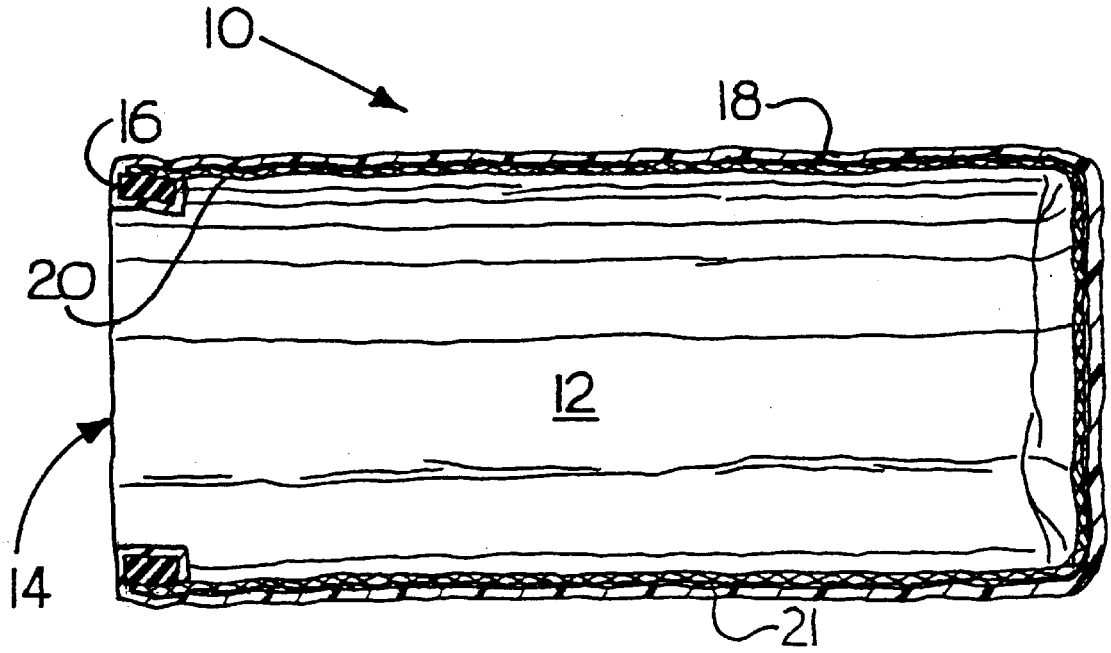
FIG. 3 is a sectional view along a longitudinal axis of the device shown in FIG. 2.

FIGS. 1–3 show a container 10 for collecting, absorbing and retaining human or animal waste material made in accordance with the present invention. The container 10 is formed as a portable and disposable bag defining an internal pocket 12 having a mouth opening 14. The container 10 further includes a resiliently deformable collar 16 surrounding a periphery of the mouth opening 14 and defining the mouth opening 14. The resiliently deformable collar 16 may be made of rubber or another similarly deformable and elastic material. The resiliently deformable collar 16 is adapted to maintain the mouth opening 14 in an open configuration as shown in FIG. 1. The collar 16 may also be made of a cardboard material having a sufficient thickness whereby the cardboard material is at least partially resiliently deformable.

A nonpermeable and flexible outer layer 18 defines the boundary of the internal pocket 12. The nonpermeable and flexible outer layer 18, as shown in FIG. 1, encloses the resiliently deformable collar 16. The nonpermeable and flexible outer layer 18 is preferably made of plastic or, more appropriately, a textured non-woven breathable elastic film for a non-slip grip. Suitable elastic films include the hydrophobic sheet breathable elastic film/non-woven laminate disclosed by U.S. Pat. No. 5,883,028 to Morman et al. incorporated herein by reference, or the anisotropic elastic film disclosed by U.S. Pat. No. 5,885,908 to Jaeger et al., also incorporated herein by reference. The collar 16 may also be made of the same material as the nonpermeable and flexible outer layer 18 (an elastic film), only having a greater thickness to provide the collar 16 with resiliency. A liquid absorbent inner layer 20 is attached to the nonpermeable and flexible outer layer 18 and is positioned in the internal pocket 12. The liquid absorbent inner layer 20 is preferably thermally bonded or fused to the nonpermeable and flexible outer layer 18. The liquid absorbent inner layer 20 may also be adhesively bonded to the nonpermeable and flexible outer layer 18 by an adhesive layer 21, as shown in FIG. 3. However, the liquid absorbent inner layer 20 is not required to be bonded to the nonpermeable and flexible outer layer 18 over the entire length of the liquid absorbent inner layer 20. For example, the liquid absorbent inner layer 20 may be attached to the nonpermeable and flexible outer layer 18 only around the resiliently deformable collar 16 adjacent the mouth opening 14. The liquid absorbent inner layer 20 may also be mechanically attached to the nonpermeable and flexible outer layer 18 with staples or stitching, however, thermal or adhesive bonding is preferred.

The liquid absorbent inner layer 20 forms a surface 22 of the internal pocket 12, as shown in FIG. 3, and is adapted to absorb human or animal liquid waste material such as urine or blood. Preferably, the liquid absorbent inner layer 20 is adapted to absorb between 50 and 500 cubic centimeters of human or animal liquid waste material (500 cubic centimeters is considered to be the maximum capacity of an adult human bladder). Consequently, the liquid absorbent inner layer 20 is made of cotton, a polymer material such as that found in disposable diapers, or other suitably absorbent materials such as wood pulp fluff, or a porous fiber matrix. The absorbent inner layer 20 may include superabsorbent polymers (SAP) or hydrogels therein for absorbing liquid waste material. Suitable absorbent materials are disclosed in U.S. Pat. Nos. 5,147,343 to Kellenberger; U.S. Pat. No. 5,886,124 to Kightlinger et al.; and U.S. Pat. No. 5,885,263 to Gancet et al., each incorporated herein by reference.

The design of the container 10, with the resiliently deformable collar 16 biasing the mouth opening 14 in the open configuration, enables the user of the container 10 to operate the container 10 with one hand. In addition, the container 10, in use, provides a 360° range of absorbency for the user of the container 10. Consequently, a closure system for the mouth opening 14 is unnecessary. However, a closure system (not shown) may be incorporated into the container 10 to close the mouth opening 14. Any such closure system would include releasable tabs much like those used in disposable diapers as are well known in the art.

Although FIGS. 1–3 show the container 10 having an elongated tubular form, it is envisioned that the container 10 can be formed in a rectangular form (not shown) having the mouth opening 14 along one of the long edges of the rectangle. The mouth opening 14 would thus be larger to accommodate the needs of women users of the container 10. In this embodiment, the resiliently deformable collar 16 surrounding the periphery of the mouth opening 14 could be formed in an oval shape. It is believed that the rectangular form of the present invention is also suitable for collecting human or animal feces. Finally, it will be appreciated by those skilled in the art that the internal pocket 12 is formed with sufficient dimensions to receive and store human or animal feces therein. Other shapes and sizes of the container 10 such as oval and circular shapes are also envisioned by the present invention.

Although this invention has been described with reference to preferred embodiments, obvious modifications and alterations of the invention may be made without departing from the spirit and scope of the present invention. The scope of the present invention is defined by the appended claims and equivalents thereto.

I claim:

1. An elongated portable, disposable container for collecting, absorbing and retaining urine for one handed user operation, the container comprising:

a continuous, resiliently deformable collar member for biasing a mouth opening of the container outwardly and maintaining the mouth opening in a normally open configuration for single handed use of the urine collecting container, with the collar member providing unimpeded access to the interior of the container in the open configuration;

a nonpermeable and flexible outer layer substantially and permanently enclosing the collar member and defining an internal pocket having sidewalls and one closed endwall and defining an outer gripping surface for one hand of the user;

a liquid absorbent inner layer lining the internal pocket up to the collar member and attached by one of thermal bonding, adhesive bonding and stitching to the outer layer along substantially an entire outer surface of the inner layer, wherein the inner layer forms a surface of the internal pocket and is made of a material selected from the group consisting of cotton, wood pulp fluff, and porous fiber matrix containing one of a superabsorbent polymer and a hydrogel and is adapted to absorb between about 50 and 500 cubic centimeters of urine, and wherein the container is further adapted to retain solid waste material deposited in the internal pocket, and wherein the container is adapted to be used with one hand by a user.

2. The container of claim 1, wherein the inner layer is thermally bonded to the outer layer.

3. The container of claim 1, wherein the inner layer is adhesively bonded to the outer layer.

4. The container of claim 1, wherein the collar member is made of rubber.

5. The container of claim 1, wherein the collar member is made of cardboard material having a sufficient thickness such that the cardboard collar member is at least partially resiliently deformable.

6. A portable, disposable tubular-shaped container for collecting, absorbing and retaining urine, comprising:

a continuous, resiliently deformable collar member for biasing a mouth opening of the container outwardly and maintaining the mouth opening in a normally open configuration, with the collar member providing unimpeded access to the interior of the container in the open configuration for one handed operation of the urine collecting container;

a nonpermeable and flexible outer layer substantially and permanently, enclosing the collar member and defining an internal pocket having a sidewall and one closed endwall and defining an external gripping surface for one hand of the user; and a liquid absorbent inner layer lining the internal pocket up to the collar member and attached by one of thermal bonding, adhesive bonding and stitching to the outer layer along substantially an entire outer surface of the inner layer, wherein the inner layer forms a surface of the internal pocket and is made of a material selected from the group consisting of cotton, wood pulp fluff, and porous fiber matrix containing one of a superabsorbent polymer and a hydrogel and is adapted to absorb between about 50 and 500 cubic centimeters of urine, and wherein the container is further adapted to retain solid waste material deposited in the internal pocket, and wherein the container is tubular-shaped and adapted to be used with one hand by a user.

7. The container of claim 6, wherein the inner layer is thermally bonded to the outer layer.

8. The container of claim 6, wherein the collar member is made of rubber.

9. The container of claim 6, wherein the collar member is made of cardboard material having a sufficient thickness such that the cardboard collar member is at least partially resiliently deformable.

10. The container of claim 6, wherein the inner layer is adhesively bonded to the outer layer.

* * * * *